United States Patent [19]

Childs

[11] 4,378,274

[45] Mar. 29, 1983

[54] METHOD OF ELECTROPLATING VERY THIN METAL PARTS

[75] Inventor: Bobby D. Childs, Houston, Tex.

[73] Assignee: Mark Products, Inc., Houston, Tex.

[21] Appl. No.: 353,072

[22] Filed: Mar. 1, 1982

[51] Int. Cl.[3] ..... C25D 5/00

[52] U.S. Cl. ..... 204/23

[58] Field of Search ..... 204/23, 213, 215, 32 R

[56] References Cited

U.S. PATENT DOCUMENTS 3,803,007 4/1974 Jessup ..... 204/23

4,337,135 6/1982 Quinton ..... 204/213

OTHER PUBLICATIONS

Metal Finishing Guidebook & Directory, vol. 77, No. 13, Jan. 1979, pp. 398–414.

*Primary Examiner*—T. M. Tufariello

*Attorney, Agent, or Firm*—Vaden, Eickenroht, Thompson, Bednar & Jamison

[57] ABSTRACT

A method of plating simultaneously a large number of non-flat metal parts of very thin, easily bent material is disclosed. The parts of this type such as geophone springs are placed in a plating barrel in loose condition, and the barrel is submerged at least halfway into the plating solution. After a short period of time, rotation of the barrel is begun and allowed to continue for awhile before the electroplating current is turned on. The tumbling action imported to the geophone springs, which causes them to move into and out of electrical contact with each other and with the cathodes in the barrel, extends the time required to plate these very thin members with the desired coating of metal, usually silver or gold, thereby decreasing the criticalness of the length of time the plating current is on, thereby increasing the uniformity of the coatings obtained and reducing the number of rejects.

1 Claim, 3 Drawing Figures

METHOD OF ELECTROPLATING VERY THIN METAL PARTS

This invention relates to a method of plating simultaneously a large number of non-flat metal parts of very thin, easily bent material.

This invention has utility for plating simultaneously large numbers of any non-flat metal parts of very thin, easily bent material, but it is particularly useful in plating geophone springs after they have been heat treated and preformed.

A typical velocity geophone includes a permanent magnet that is fixed relative to the case or housing of the geophone and a coil-mass supported by springs that allow the coil-mass to move relative to the permanent magnet when the earth moves. As the coil moves through the field of the permanent magnet, it produces an output signal that is proportional to the velocity of the movement of the coil relative to the magnet.

The springs that allow this relative movement are etched or stamped from very thin sheets of spring material. They have an outer annular portion and an inner annular portion that are connected by curved spring arms. The material most commonly used for the springs is berrylium copper.

To get the desired tensile properties, the springs are heat treated and then preformed by forcing the inner annular portion out of the plane of the outer annular portion far enough to cause the spring arms to take a permanent set and hold the inner annular portion displaced from the plane of the outer annular portion a preselected distance. This distance varies depending upon the spring rate of the spring and other factors but is usually about one-quarter of an inch. The springs are preformed so that when the weight of the coil-mass is placed on the outer annular portion of the spring, the outer annular portion of the spring will move into substantial alignment with the plane of the inner annular portion of the spring.

Since in most geophone constructions the springs act as electrical conductors that connect the coil to the output terminals of the geophone, the springs are electroplated with either silver or gold to improve their conductivity. Even if they are not used as electrical conductors, it is preferable to plate these members to reduce corrosion of the berrylium copper.

In the past, such springs have been plated with either silver or gold successfully in conventional tumbler type barrels when they are flat, i.e., before they were preformed. They would then be heat treated and preformed after the plating operation. Preferably, however, the heat treatment and the preforming operation are performed before the springs are plated. This allows these operations to be done without concern about their effect on the plating.

It was believed that preformed springs could not be placed loose in a conventionl plating barrel because they would become so tangled that it would be very difficult and time consuming to separate them without damage. Therefore, the procedure used was to mount the springs individually on a rack that would be immersed in the plating solution. The rack was designed to hold each spring separately and out of contact with the other springs to eliminate any chance that they would become tangled.

The springs could be very successfully plated using the rack, but it required mounting each spring individually by hand on the rack and removing each spring individually by hand from the rack. This was a time consuming and expensive operation. Plus many springs were damaged as they were loaded and unloaded from the rack.

It is an object of this invention to provide a novel method of electroplating simultaneously a number of non-flat members that are thin and easily bent, such as preformed geophone springs, that employs a conventional tumbling barrel with the springs placed loose in the barrel in the conventional manner, thereby eliminating the use of the rack described above, which results in the number of rejects being greatly reduced.

It is another object and feature of this invention to provide such an electroplating method wherein the length of time required to plate the members with the desired thickness of metal is increased. This greatly reduces the chance for error in the plating operation. This results because with the rack described above, when the current was turned on, each spring was immediately connected into the plating circuit and metal began to be deposited on the surface of the members immediately. Thus the time required to deposit the desired thickness of metal was very short. With the method of this invention, the members are tumbled in the plating solution as the barrel rotates and make random electrical contact with the cathode and with each other. This requires the time allowed for the plating to be extended substantially and thus the timing of the plating operation is much less critical. This results in a much more uniformly plated product and a substantial reduction in the rejections.

These and other objects, advantages, and features of this invention will be apparent to those skilled in the art from a consideration of this specification, including the attached drawings and appended claims.

Figure 1:
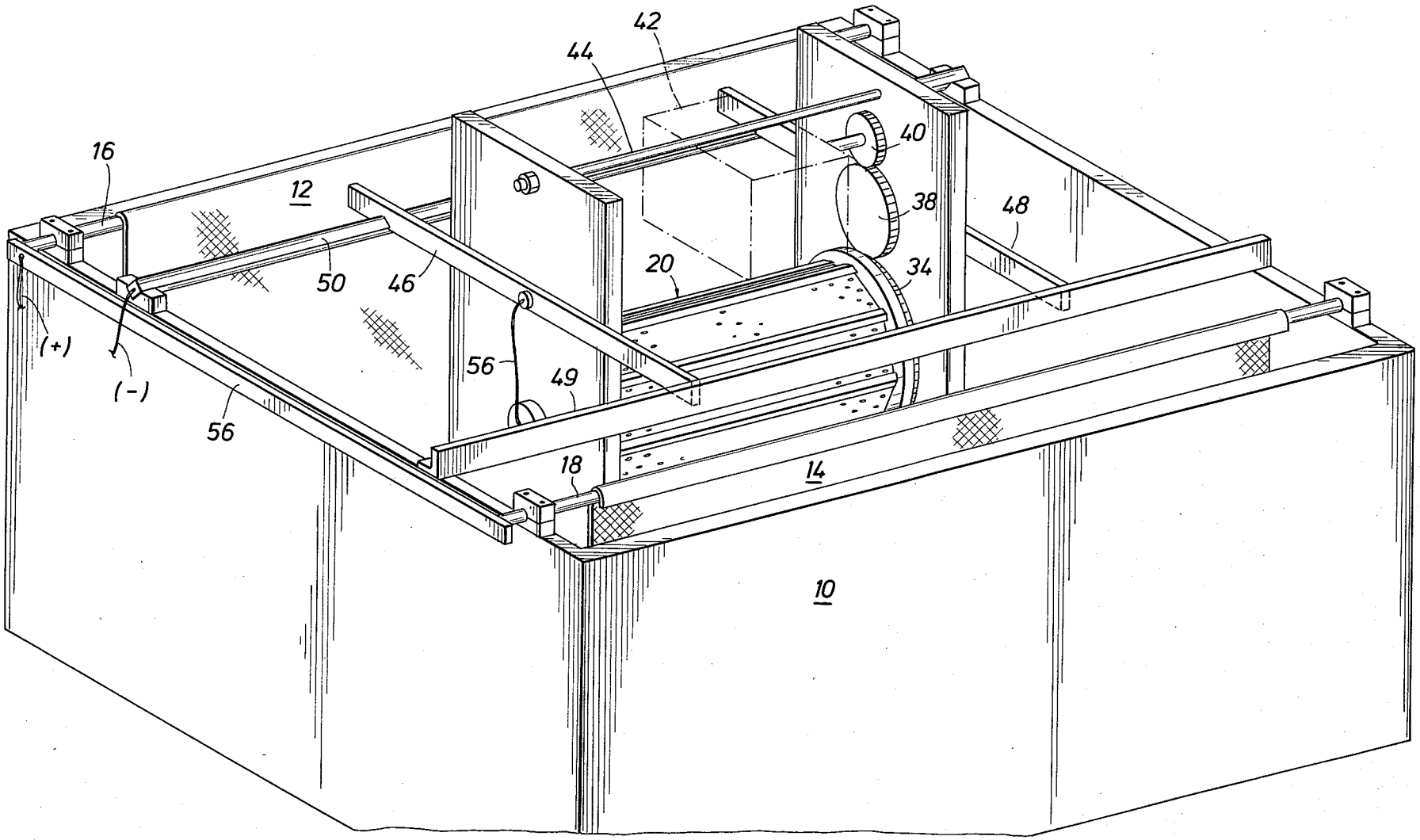
FIG. 1 is an isometric view of conventional electroplating apparatus using a rotating barrel to tumble the members being plated in the plating solution.

The plating apparatus shown in FIG. 1 includes tank 10 in which the proper plating solution is placed for depositing the desired metal on the members to be plated, which are the cathodes in the plating circuit. The anodes are plates 12 and 14 that are suspended in tank 10 from support rods 16 and 18 that extend across the top of the tank.

Figure 2:
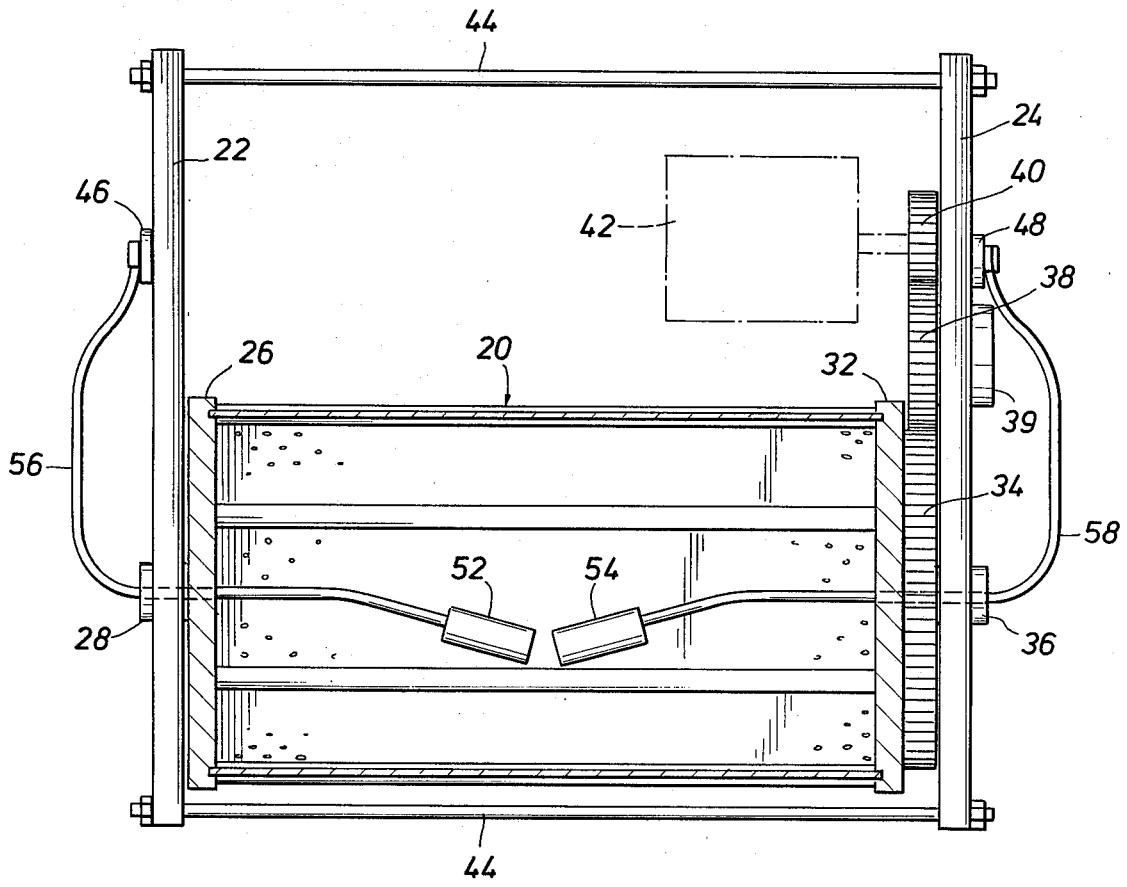
FIG. 2 is a side view of the barrel assembly.

The members or parts to be plated are placed loose in barrel 20. In this embodiment, the barrel is octagonal in cross-section. As shown in FIG. 2, it is mounted for rotation around its longitudinal axis on mounting plates 22 and 24. End flange 26 of the barrel is mounted for rotation on mounting plate 22 by shaft 28.

Flange 32 on the opposite end of the barrel is attached to gear 34, which is mounted for rotation on shaft 36. Bearings (not shown) mounted in mounting plates 22 and 24 support shafts 28 and 36 for rotation relative to the mounting plates. Gear 34 meshes with idler gear 38, which, in turn meshes with pinion 40, which is mounted on the output shaft of motor 42. The motor, shown with phantom lines, rotates pinion 40 to rotate the barrel. Idler 38 is supported for rotation by a shaft (not shown) that is supported by bearings in housing 39. Tie rods 44 hold the mounting plates parallel.

The barrel assembly is supported in tank 10 by support rods 46 and 48. One end of each support rod engages angle 49 that extends across the top of the tank. Each support rod has a V-shaped notch to engage the upper two sides of square rod 50 that also extends across the top of tank 10. The engagement of the V-shaped notches and the sides of the square rod holds the barrel against lateral movement.

Cylindrical members 52 and 54 of electrically conductive material are positioned inside the barrel. These members are the cathodes in the electroplating circuit. They are attached to the end of insulated flexible conductors 56 and 58 so they are free to flop around as the barrel rotates. Usually, the barrel will be submerged in the plating solution about halfway or a little more so that cathodes 52 and 54 will be submerged at all times during the plating operation.

Conductors 56 and 58 extend out of the barrel through hollow shafts 28 and 36 and are connected to the negative side of the current source through support rods 46 and 48 and V-shaped member 50. Plates 12 and 14 are electrically connected to the positive side of the current source through bus bar 56 and are the anodes of the electroplating circuit.

Figure 3:
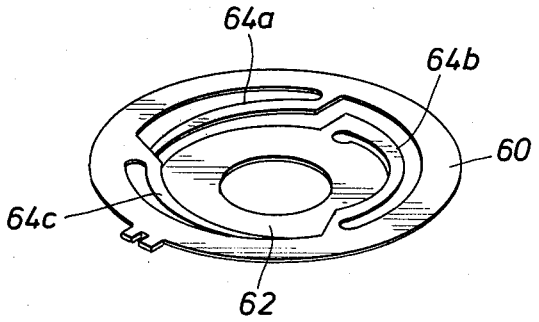
FIG. 3 is an isometric view of a typical geophone spring after it has been preformed.

As stated above, this invention is particularly useful in the plating of springs used in geophones after they have been heat treated and preformed. FIG. 3 is an isometric view of a typical heat treated, preformed spring used in a geophone. It includes outer annular section 60 and inner annular section 62. The two annular sections are connected by three curved spring arms 64*a*, 64*b*, and 64*c*. As explained above, the springs are stamped or etched from a sheet of spring material, usually berrylium copper. They are then heat treated and preformed so that the two annular sections are displaced as shown in FIG. 3. The springs are now ready to be plated. A typical spring is about one inch in diameter and is made from sheet material about 0.0045 inches thick. An example of the procedure for silverplating such springs in batches of about 500, employing the method of this invention, is as follows:

The springs will come to the plating department loosely packed in a container, and some of them may be tangled, so the first step is to make sure that all of the springs are separated from each other. The springs will usually have grease and other grime on their surface, so they should be cleaned in a solution of 85 percent concentrated sulfuric acid, comprising three parts sulfuric acid and one part water. The springs are left in the acid bath for about four minutes. They are then washed with water for about two minutes to remove the sulfuric acid and placed in the plating barrel. The barrel assembly is positioned in tank 10, as shown in FIG. 1, with at least half of the barrel submerged in the plating solution. The barrel should never be rotated when it is out of the plating solution because this could cause damage to the springs and also cause them to tangle.

When the barrel has been placed in the silverplating solution, it should not be rotated immediately. In other words, there should be time allowed to allow the springs to settle before the barrel is rotated. Then, before the plating current is turned on, the rotation of the barrel is started. Fifteen to twenty seconds later the plating current is turned on. The barrel will impart a tumbling action to the springs and they will move into and out of contact with each other and cathodes 52 and 54 and be part of the cathode of the circuit. A typical current used is 10 amps for about one and a half minutes for 500 geophone springs. After the power has been turned off, the barrel is stopped and removed from the solution and placed in rinse water for about one minute. The springs are then removed from the barrel and placed in alcohol for about fifteen seconds; then dried.

As stated above, by using the method of this invention, small, thin, easily bent members or parts, such as springs for geophone, can be plated in large numbers in a conventional tumbling barrel without suffering damage. The method actually results in a decrease in the number of rejects previously produced by the rack system where the springs were indivudally mounted and held separated from each other.

Using the same procedure, as many as a thousand geophone springs can be plated simultaneously in a barrel that's about 12 inches long and 9½ inches in diameter.

From the foregoing, it will be seen that this invention is one well adapted to attain all of the ends and objects hereinabove set forth, together with other advantages that are obvious and that are inherent to the method.

The invention having been described, what is claimed is:

1. A method of electroplating a large number of relatively thin, easily bent, non-flat, metal members, such as the springs used in geophones, comprising the steps of separating any of the members that may be entangled, cleaning the surface of the members, placing the members in a plating barrel, submerging about half the barrel in a plating solution, letting the members settle for a brief period of time, rotating the barrel along a horizontal axis a few revolutions with the electroplating circuit off to impart a tumbling action to the members, turning on the electroplating circuit for the length of time required to plate the members as the barrel rotates, turning the electroplating circuit off, removing the barrel from the plating solution, rinsing the plating solution from the members, and removing the plated members from the barrel.

* * * * *